US011262157B1

(12) United States Patent
Jiang

(10) Patent No.: US 11,262,157 B1
(45) Date of Patent: Mar. 1, 2022

(54) FIXING AND CLAMPING DEVICE FOR A SWORD

(71) Applicant: Longquan Shenghe Sword Co., Ltd., Lishui (CN)

(72) Inventor: Songgen Jiang, Longquan (CN)

( * ) Notice: Subject to any disclaimer, the term of this patent is extended or adjusted under 35 U.S.C. 154(b) by 0 days.

(21) Appl. No.: 17/020,745

(22) Filed: Sep. 14, 2020

(30) Foreign Application Priority Data

Aug. 5, 2020 (CN) ..... 202021606099.7

(51) Int. Cl.
*F41B 13/02* (2006.01)

(52) U.S. Cl.
CPC ..... *F41B 13/02* (2013.01)

(58) Field of Classification Search
CPC ..... F41B 13/02; F41B 13/04
USPC ..... 30/342, 344
See application file for complete search history.

(56) References Cited

U.S. PATENT DOCUMENTS 1,371,881 A * 3/1921 Fasson ..... F41B 13/02 30/162
2004/0127292 A1* 7/2004 Chan ..... F41B 13/02 463/47.2

FOREIGN PATENT DOCUMENTS

CA 2494791 A1 * 7/2006 ..... F41B 13/02
DE 3414912 A1 * 10/1985 ..... F41B 13/02

* cited by examiner

*Primary Examiner* — Omar Flores Sanchez
(74) *Attorney, Agent, or Firm* — Che-Yang Chen; Law Office of Michael Chen

(57) ABSTRACT

A fixing and clamping device for a sword includes a sword scabbard and a sword body located in the sword scabbard. The top of the sword body is provided with a blade extending above the sword scabbard. A fixing shell matching with the blade is sleeved on the blade. The fixing shell is connected to the blade through a bamboo pin. A first hilt fixing shell and a second hilt fixing shell are sleeved on the fixing shell and matched with the fixing shell. A plurality of clamping blocks are uniformly distributed on the side of the first hilt fixing shell adjacent to the second hilt fixing shell. A plurality of clamping slots matching with the plurality of clamping blocks are uniformly distributed on the side of the second hilt fixing shell adjacent to the first hilt fixing shell.

3 Claims, 2 Drawing Sheets

FIXING AND CLAMPING DEVICE FOR A SWORD

CROSS REFERENCE TO THE RELATED APPLICATIONS

This application is based upon and claims priority to Chinese Patent Application No. 202021606099.7, filed on Aug. 5, 2020, the entire contents of which are incorporated herein by reference.

TECHNICAL FIELD

The present invention relates to the technical field of swords, and more particularly, to a fixing and clamping device for a sword.

BACKGROUND

A sword is made of metal and consists of a blade and a hilt. The sword is a short ancient melee weapon and has long been known as "the monarch of weapons". In Eastern and Western civilizations, the sword symbolizes a high status and is typically regarded as a noble decoration.

The blade is securely attached to the hilt to avoid the danger caused by disengaging of the blade in use. Some swords have the same hilt, and only differ in the blade and handguard. Currently available swords need to be purchased separately.

An effective solution to the above-mentioned problems, however, remains absent in the prior art.

SUMMARY

In view of the above-mentioned problems in the prior art, the present invention provides a fixing and clamping device for a sword to overcome the above-mentioned technical problems in the prior art.

The present invention adopts the following technical solution.

A fixing and clamping device for a sword includes a sword scabbard and a sword body located in the sword scabbard. The top of the sword body is provided with a blade extending above the sword scabbard. A fixing shell matching with the blade is sleeved on the blade. The fixing shell is connected to the blade through a bamboo pin. A first hilt fixing shell and a second hilt fixing shell are sleeved on the fixing shell and matched with the fixing shell. A plurality of clamping blocks are uniformly distributed on the side of the first hilt fixing shell adjacent to the second hilt fixing shell. A plurality of clamping slots matching with the plurality of clamping blocks are uniformly distributed on the side of the second hilt fixing shell adjacent to the first hilt fixing shell. A plurality of anti-slip strips are uniformly distributed on the inner wall of the side of the first hilt fixing shell adjacent to the second hilt fixing shell. A plurality of anti-slip strips are uniformly distributed on the inner wall of the side of the second hilt fixing shell adjacent to the first hilt fixing shell. Each of an inner cavity of the first hilt fixing shell and an inner cavity of the second hilt fixing shell has a tapered structure.

Preferably, the first hilt fixing shell is connected to the second hilt fixing shell by a screw.

Preferably, a groove matching with the bamboo pin is provided in the blade.

Preferably, a handguard is provided on one side of the blade.

The advantages of the present invention are as follows. Through the cooperation between the clamping block, the clamping slot and the screw, it is convenient to install and disassemble the sword. Moreover, the handguard, the blade, the hilt fixing shell and other components can be disassembled for transportation, which reduces the space occupation and transportation costs. The blade body, the handguard, and the hilt can be replaced as needed to reduce the use cost, especially replaced with different styles for costume play (cosplay) activities according to different objects. In this way, different cosplay activities can be completed only by replacing some required accessories.

BRIEF DESCRIPTION OF THE DRAWINGS

In order to explain the embodiments of the present invention or the technical solutions in the prior art more clearly, the drawings used in the embodiments will be briefly introduced below. Obviously, the drawings in the following description are only some embodiments of the present invention. For those having ordinary skill in the art, other drawings can be obtained from these drawings without creative efforts.

In the figures.

Figure 1:
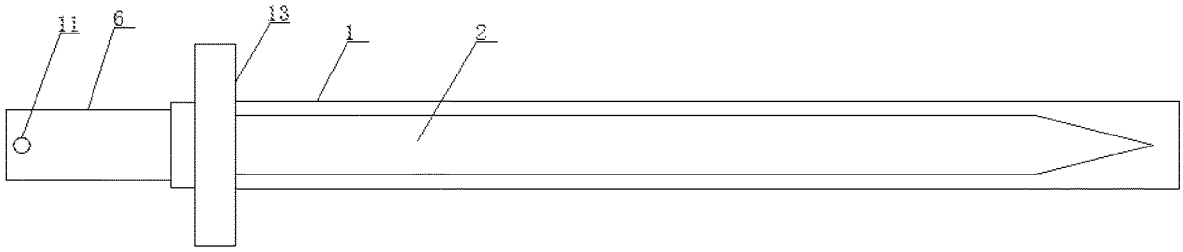
FIG. 1 is a schematic structural view of the fixing and clamping device for the sword according to an embodiment of the present invention.

1, sword scabbard; 2, sword body; 3, blade; 4, fixing shell; 5, bamboo pin; 6, first hilt fixing shell; 7, second hilt fixing shell; 8, clamping block; 9, clamping slot; 10, anti-slip strip; 11, screw; 12, groove; 13, handguard.

DETAILED DESCRIPTION OF THE EMBODIMENTS

In order to further explain the embodiments, the present invention is described with the drawings. These drawings are part of the disclosure of the present invention and are mainly used to illustrate the embodiments and explain the operating principles of the embodiments in combination with the relevant description in the specification. With reference to these contents, those having ordinary skill in the art should be able to understand other possible implementations and the advantages of the present invention. The components in the figures are not drawn to scale, and similar component reference numerals are generally used to indicate similar components.

According to an embodiment of the present invention, a fixing and clamping device for a sword is provided.

Embodiment 1

Figure 2:
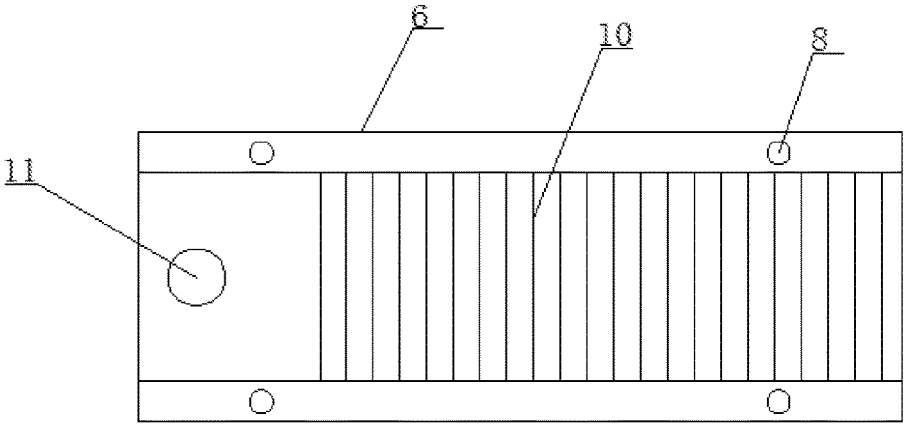
FIG. 2 is a structural schematic view of the first hilt fixing shell in the fixing and clamping device for the sword according to an embodiment of the present invention.
Figure 3:
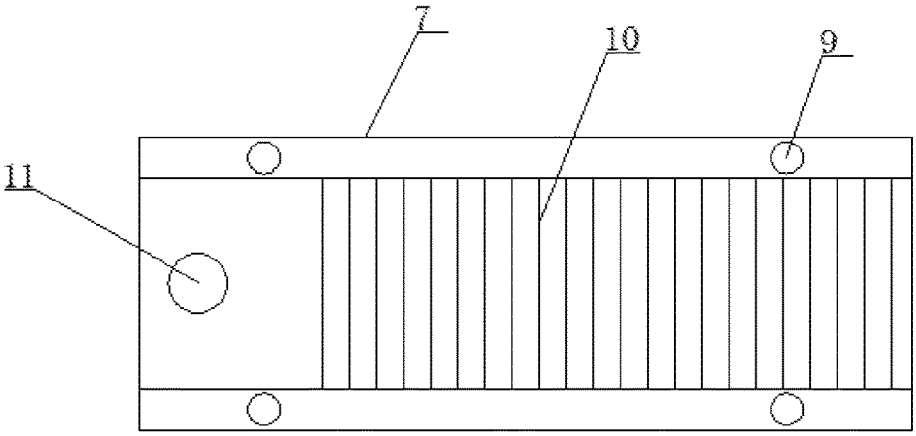
FIG. 3 is a schematic structural view of the second hilt fixing shell in the fixing and clamping device for the sword according to an embodiment of the present invention.
Figure 4:
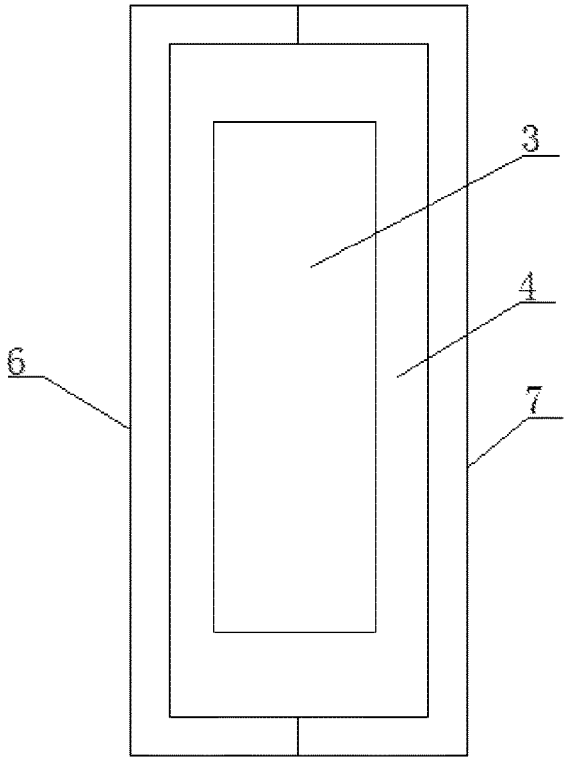
FIG. 4 is a side view of the fixing shell in the fixing and clamping device for the sword according to an embodiment of the present invention.
Figure 5:
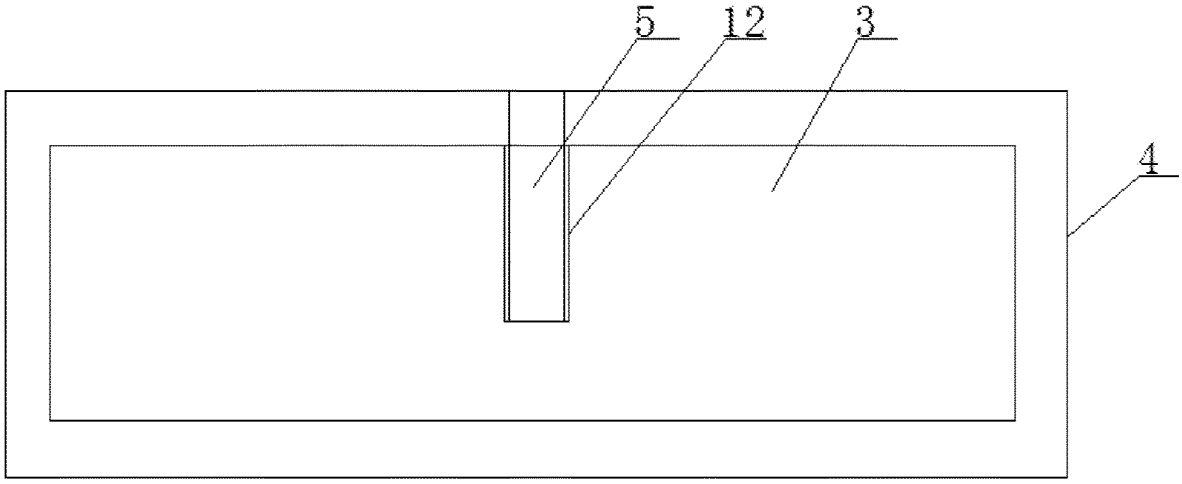
FIG. 5 is a side view of the blade in the fixing and clamping device for the sword according to an embodiment of the present invention.

As shown in FIGS. 1-5, a fixing and clamping device for a sword according to an embodiment of the present invention includes the sword scabbard 1 and the sword body 2 located in the sword scabbard 1. The top of the sword body 2 is provided with the blade 3 extending above the sword scabbard 1. The fixing shell 4 matching with the blade 3 is sleeved on the blade 3. The fixing shell 4 is connected to the blade 3 through the bamboo pin 5. The first hilt fixing shell 6 and the second hilt fixing shell 7 are sleeved on the fixing shell 4 and matched with the fixing shell 4. A plurality of clamping blocks 8 are uniformly distributed on the side of the first hilt fixing shell 6 adjacent to the second hilt fixing shell 7. A plurality of clamping slots 9 matching with the plurality of clamping blocks 8 are uniformly distributed on the side of the second hilt fixing shell 7 adjacent to the first hilt fixing shell 6. A plurality of anti-slip strips 10 are uniformly distributed on the inner wall of the side of the first hilt fixing shell 6 adjacent to the second hilt fixing shell 7. A plurality of anti-slip strips 10 are uniformly distributed on the inner wall of the side of the second hilt fixing shell 7 adjacent to the first hilt fixing shell 6. Each of the inner cavity of the first hilt fixing shell 6 and the inner cavity of the second hilt fixing shell 7 has a tapered structure.

Embodiment 2

As shown in FIGS. 1-5, the first hilt fixing shell 6 is connected to the second hilt fixing shell 7 by the screw 11. The groove 12 matching with the bamboo pin 5 is provided in the blade 3. The handguard 13 is provided on one side of the blade 3. The handguard 13 is designed by a conventional method, and thus will not be elaborated herein.

In order to facilitate the understanding of the foregoing technical solution of the present invention, the working principle or operation mode of the present invention in the practical process will be described in detail below.

In practical applications, the fixing shell 4 is fixed on the blade 3 by the bamboo pin 5. The first hilt fixing shell 6 and the second hilt fixing shell 7 are combined and placed into the cavity at the front end of the hilt. The fixing shell 4 is inserted into the cavity between the first hilt fixing shell 6 and the second hilt fixing shell 7 to fix the outer wall of the fixing shell 4 by the anti-slip strips 10 on the first hilt fixing shell 6 and the second hilt fixing shell 7 abutting against the fixing shell 4. The interior of each of the first hilt fixing shell 6 and the second hilt fixing shell 7 is tapered. After installation, the first hilt fixing shell 6 and the second hilt fixing shell 7 are firmly fixed by the screw 11 and prevented from moving. During the disassembling process, the screw 11 is unscrewed, and the blade 3 is pulled out from the first hilt fixing shell 6 and the second hilt fixing shell 7. Then, the fixing shell 4 is opened, so that the blade 3 can be removed, and after replacing components, the blade 3 is reinstalled.

To sum up, by means of the foregoing technical solution of the present invention, it is convenient to install and disassemble the sword through the cooperation between the clamping block 8, the clamping slot 9 and the screw 11. Moreover, the handguard 13, the blade 3, the hilt fixing shell and other components can be disassembled for transportation, which reduces the space occupation and transportation costs. The blade body, the handguard, and the hilt can be replaced as needed to reduce the use cost, especially replaced with different styles for cosplay activities according to different objects. In this way, different cosplay activities can be completed only by replacing some required accessories.

The above descriptions are only the preferred embodiments of the present invention, and are not intended to limit the present invention. Any modification, equivalent replacement, improvement, and the like made within the spirit and principle of the present invention shall fall with the scope of protection of the invention.

What is claimed is:

1. A fixing and clamping device for a sword, comprising a sword scabbard, and a sword body; wherein the sword body is located in the sword scabbard;

a blade extending from one end of the sword body above the sword scabbard;

a fixing shell matching with the blade is sleeved on the blade;

the fixing shell is connected to the blade through a bamboo pin;

a first hilt fixing shell and a second hilt fixing shell are sleeved on the fixing shell and matched with the fixing shell;

a plurality of clamping blocks are uniformly distributed on a side of the first hilt fixing shell, wherein the side of the first hilt fixing shell is adjacent to the second hilt fixing shell;

a plurality of clamping slots matching with the plurality of clamping blocks are uniformly distributed on a side of the second hilt fixing shell, wherein the side of the second hilt fixing shell is adjacent to the first hilt fixing shell;

a plurality of first anti-slip strips are uniformly distributed on an inner wall of the side of the first hilt fixing shell;

a plurality of second anti-slip strips are uniformly distributed on an inner wall of the side of the second hilt fixing shell; and each of the first hilt fixing shell and the second hilt fixing shell has an inner cavity.

2. The fixing and clamping device according to claim 1, wherein, the first hilt fixing shell is connected to the second hilt fixing shell by a screw.

3. The fixing and clamping device according to claim 1, wherein, a groove matching with the bamboo pin is provided in the blade.

* * * * *